US010773416B1

(12) United States Patent
Lee

(10) Patent No.: US 10,773,416 B1
(45) Date of Patent: Sep. 15, 2020

(54) SPLIT WOOD RETENTION DEVICE

(71) Applicant: Richard Lee, Valemount (CA)

(72) Inventor: Richard Lee, Valemount (CA)

( * ) Notice: Subject to any disclaimer, the term of this patent is extended or adjusted under 35 U.S.C. 154(b) by 392 days.

(21) Appl. No.: 15/497,979

(22) Filed: Apr. 26, 2017

Related U.S. Application Data

(60) Provisional application No. 62/327,757, filed on Apr. 26, 2016.

(51) Int. Cl.
*B27L 7/00* (2006.01)

(52) U.S. Cl.
CPC ..... *B27L 7/00* (2013.01)

(58) Field of Classification Search
CPC .... B25B 1/00; B25B 1/20; B25B 3/00; B25B 5/00; B25B 5/14
USPC ..... 29/278; 269/3, 6, 131, 130
See application file for complete search history.

(56) References Cited

U.S. PATENT DOCUMENTS 152,940 A * 7/1874 Bean ..... B67B 7/18 81/3.32
1,636,880 A * 7/1927 Stiles ..... B25B 1/205 269/130
1,785,884 A * 12/1930 Vosper ..... B25B 1/20 269/130
2,120,497 A * 6/1938 Heinrich ..... F16G 11/12 24/68 CT
2,132,697 A * 10/1938 Neifert ..... B67B 7/184 269/131
2,452,985 A * 11/1948 Bourdette ..... B23K 37/0536 269/40
2,531,052 A * 11/1950 Kehoe ..... A47J 45/00 81/3.32
2,583,917 A * 1/1952 Wiegant ..... B23C 7/00 269/130
2,604,678 A * 7/1952 Mayes ..... F16G 15/00 24/598.1
2,638,647 A * 5/1953 Nielsen ..... F16G 11/12 24/68 CT
2,679,939 A * 6/1954 Yates ..... B23K 37/0538 269/130
3,047,286 A * 7/1962 Kinne ..... F16L 1/10 269/130

(Continued)

FOREIGN PATENT DOCUMENTS

GB 677431 A * 8/1952 ..... B25B 1/205

OTHER PUBLICATIONS

GB677431A, Retrieved from Espacenet on May 9, 2019 (Year: 1952).*

*Primary Examiner* — Lee D Wilson
*Assistant Examiner* — Thomas Raymond Rodgers
(74) *Attorney, Agent, or Firm* — Cramer Patent & Design, PLLC; Aaron R. Cramer

(57) ABSTRACT

A wood retention device includes two (2) chains conjoined with a spring, a locking handle, and a body. A first end of a first chain is secured to the locking handle by a locking link while the opposite second end of the first chain is secured to a locking pin. The locking handle, affixed to a first end of a second chain is hingedly secured to an outer portion of the body and the opposite second end of the second chain is removably securable to the body in a slot. The slot is configured to secure the distal end of the locking handle when in a closed position when the locking pin is passed through the apertures of the railed slot and simultaneously through an aperture located within the distal end of the locking handle.

7 Claims, 8 Drawing Sheets

(56) References Cited

U.S. PATENT DOCUMENTS 3,669,439 A * 6/1972 Sanchez ..... B25B 1/205 269/130
3,963,231 A * 6/1976 Cooper ..... B23K 37/0538 269/45
4,358,232 A * 11/1982 Griffith ..... B60P 7/0838 24/136 K
4,460,028 A * 7/1984 Henry ..... B27L 7/00 144/193.1
4,505,465 A * 3/1985 McCrary ..... B27L 7/00 144/366
4,529,170 A * 7/1985 Whitt, Sr. ..... F16H 7/14 254/131
4,934,675 A * 6/1990 Klocke ..... B25B 1/205 269/111
4,947,779 A * 8/1990 Grinde ..... B63B 21/56 114/250
4,986,043 A * 1/1991 Love ..... E04G 21/16 269/131
5,135,208 A * 8/1992 Diskin ..... B25B 1/205 269/130
5,401,011 A * 3/1995 Gatenby ..... B25B 13/52 269/131
5,494,268 A * 2/1996 Heintz ..... B25B 13/52 269/130
5,833,224 A * 11/1998 Holte ..... B25B 1/205 269/130
6,076,724 A * 6/2000 Collins, Jr. ..... B23K 37/0435 228/44.3
6,244,313 B1 * 6/2001 Sarvela ..... B25D 3/00 144/193.1
7,065,840 B2 * 6/2006 Profit ..... B25B 25/00 24/68 CD
8,186,643 B2 * 5/2012 Luo ..... F16L 41/008 248/230.8
9,199,365 B1 * 12/2015 Sim ..... B66F 15/00
9,475,640 B2 * 10/2016 Sooy ..... B65G 7/12
D798,684 S * 10/2017 Lee ..... B66F 15/00 D8/70
2009/0152783 A1 * 6/2009 Sigler ..... E04H 17/26 269/6
2011/0107574 A1 * 5/2011 Melanson ..... B23K 31/027 29/272
2016/0221169 A1 * 8/2016 LeBaron ..... B25D 1/16
2017/0080596 A1 * 3/2017 Fetter ..... B27L 7/08

* cited by examiner

SPLIT WOOD RETENTION DEVICE

RELATED APPLICATIONS

The present invention was first described in and claims the benefit of U.S. Provisional Application No. 62/327,757, filed Apr. 26, 2016, the entire disclosures of which are incorporated herein by reference.

FIELD OF THE INVENTION

The present invention relates generally to a retention device to hold wood as it is being split.

BACKGROUND OF THE INVENTION

Firewood from cut trees is used in fires all over the world on a daily basis. Whether the fire is for heating, lighting, general ambience or the like in a home or at a campsite, the wood must be cut and split for the fire. An ax, a splitting maul, wedge and sledge, or the like is commonly used when manually splitting wood. The log is placed upon a splitting stump and struck in a vertical fashion whereupon the individual pieces fall to the ground. The larger pieces are then placed upon the stump and struck again until all are small enough. Then the user must again bend over and pick up all of the individual pieces of firewood and place them in a wood pile. This results in repeated bending over which can quickly become tiring after a few short minutes, much less after a long session of splitting wood. Accordingly, there exists a need for a means by which the repeated bending over to pick up firewood during a manual splitting operation can be reduced. The use of the split wood retention device reduces the amount of work and repeated bending over associated with manual wood splitting in a manner that is quick, easy, and effective.

SUMMARY OF THE INVENTION

The inventor has recognized the aforementioned issues and inherent problems and observed that there is a lack in the prior art for a means to hold wood as it is being split.

It is therefore an object of the invention to provide a retention device, comprising a backing plate having a planar configuration. The backing plates comprises a first wing having a first wing first face, a first wing second face, a first wing first end, a first wing second end, a first wing top edge, a first wing bottom edge, an anchor plate having an anchor plate aperture which is disposed therein and secured to the first wing first face adjacent the first wing first end and between the first wing top edge and the first wing bottom edge and a first latch plate having a first latch plate aperture which is disposed therein and secured to the first wing first face adjacent an inside edge of the anchor plate and between the first wing top edge and the first wing bottom edge. The backing plate also comprises a second wing having a second wing second face, a second wing first end, a second wing second end, a second wing top edge, a second wing bottom edge and a first lock bar plate having a first lock bar plate aperture disposed therein secured to the second wing first face adjacent the second wing second end and between the second wing top edge and the second wing bottom edge and a second lock bar plate having a second lock bar plate aperture which is disposed therein secured to the second wing first face adjacent the second wind second end and between the second wing top edge and the second wing bottom edge and subjacent the first lock bar plate with the first lock bar plate aperture aligned with the second lock bar plate aperture.

The retention device also has a chain secured to the anchor plate, a latch pin secured to the first latch plate and a lock bar which is moveably secured between the first lock bar plate and the second lock bar plate. The backing plate is configured to cradle a portion of a piece of wood against the first wing second face and the second wing second face. The chain is configured to circumscribe a remainder of the piece of wood and removably secure to the lock bar. The chain is removably secured to the lock bar and when the lock bar is thereafter rotated between the first latch plate and the second latch plate and flush with the first wing first face the piece of wood is retained within the device by the latch pin being placed within the first latch plate aperture and the second latch plate aperture.

In a separate embodiment, the backing plate has a bend which comprises an angle defined between the first wing and the second wing between ninety degrees (90°) and one hundred seventy-nine degrees (179°).

The backing plate may comprise a bend between the first wing and the second wing. The chain comprises a first chain having a first chain first end and a first chain second end, a second chain having a second chain first end and a second chain second end and a spring having a spring first end connected to the first chain second end and a spring second end connected to the second chain first end. The spring is secured to the anchor plate with an anchor pin.

The latch pin may comprise a latch pin shaft having a latch pin first end and a latch pin second end, a latch pin eye secured at the latch pin first end, a latch pin aperture disposed adjacent the latch pin second end, a latch pin limit plate subjacent the latch pin eye, a latch pin retainer capable of being removably secured within the latch pin aperture and a tether secured to the latch pin eye and the first latch plate adjacent the first latch plate aperture.

The lock bar may comprise a lock bar shaft having a lock bar shaft first end and a lock bar shaft second end, a lock bar pivot secured at the lock bar shaft first end, a lock bar pivot aperture and a binder hook secured adjacent an interior side of the lock bar pivot.

The lock bar may be removably secured between the first lock bar plate and the second lock bar plate by a lock bar pivot pin removably secured within the first lock bar plate aperture, the lock bar pivot aperture and the second lock bar plate aperture. The first chain first end is removably securable to the binder hook.

The backing plate may comprise aluminum. The first wing top edge and the first wing bottom edge may comprise a first wing top edge flange and a first wing bottom edge flange. The first wing top edge flange and the first wing bottom edge flange may further comprise a contiguous second wing top edge flange and a second wing bottom edge flange.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
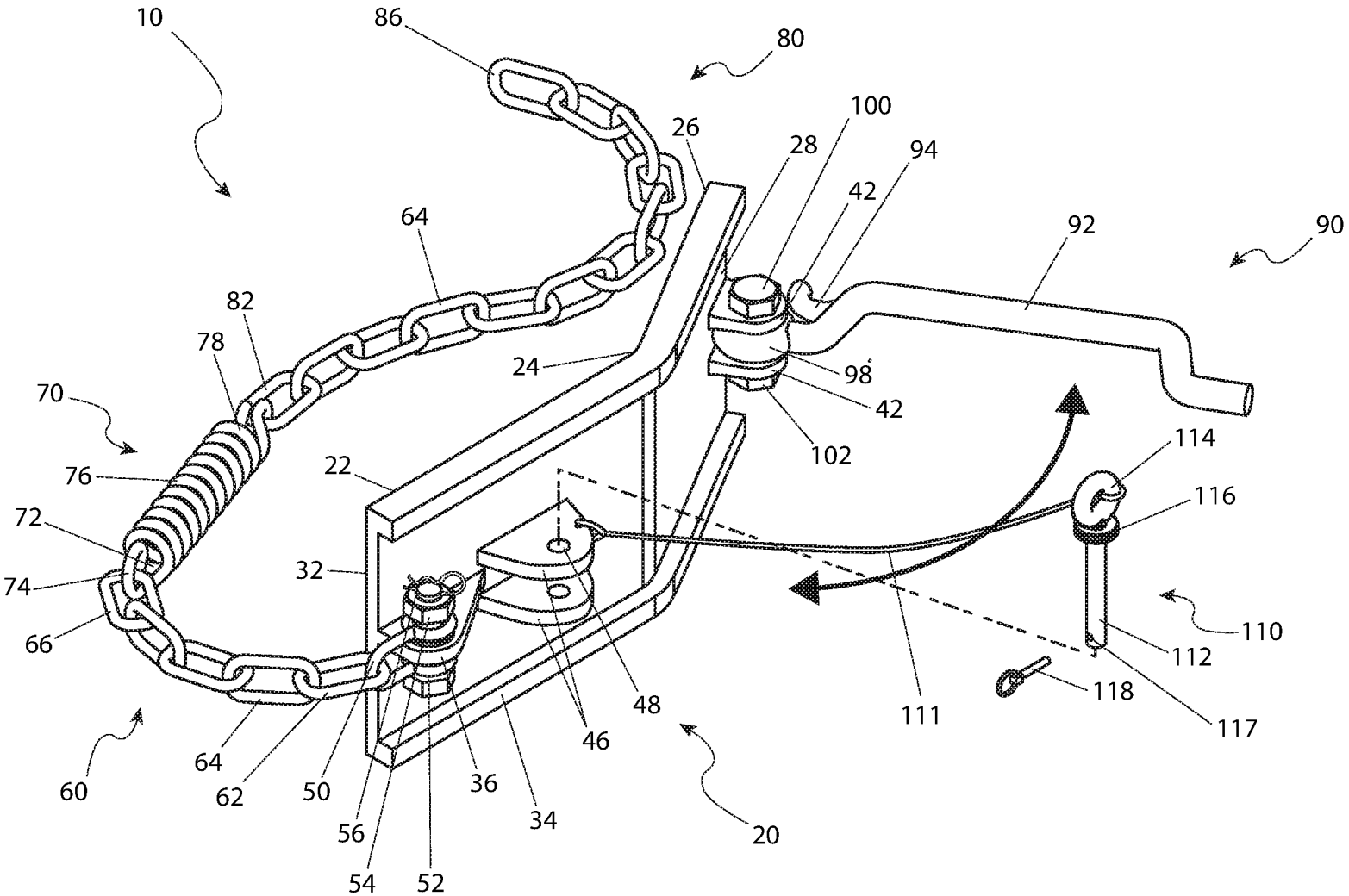
FIG. 1 is a perspective view of a wood retention device 10 in accordance with the preferred embodiment of the present invention.

10 wood retention device
20 backing plate
22 first wing
24 intermediate bend
26 second wing
28 first face
32 second face
34 reinforcement flange
36 anchor plate
42 lock bar pivot plate
46 latch plate
48 latch plate aperture
50 anchor shackle
52 anchor pin
54 anchor pin fastener
56 anchor pin retainer
60 first chain
62 first chain first end
64 chain link
66 first chain second end
70 spring
72 spring first end
74 spring eye
76 spring coil
78 spring second end
80 second chain
82 second chain first end
86 second chain second end
90 lock bar
92 lock bar shaft
94 binder hook
98 lock bar pivot
100 lock bar pivot pin
102 pivot pin fastener
104 pivot pin retainer
110 latch pin
111 tether
112 latch pin shaft
114 latch pin eye
116 latch pin limit plate
117 latch pin retainer aperture
118 latch pin retainer
200 wood piece The best mode for carrying out the invention is presented in terms of its preferred embodiment, herein depicted within FIGS. 1 through 8. However, the invention is not limited to the described embodiments, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only these particular configurations shall be shown and described for purposes of clarity and disclosure and not by way of limitation of scope.

The terms "a" and "an" herein do not denote a limitation of quantity, but rather denote the presence of at least one (1) of the referenced items.

The present invention describes a wood retention device (herein referred to as the "apparatus") 10, which provides a means to hold a wood piece 200, such as a portion of a tree trunk, or a large branch, for hand splitting and securing the split pieces thereof in a conveniently bound package after the splitting procedure so as to simplify the subsequent transfer of the wood pieces 200 to a wood pile.

Referring now to FIG. 1, a perspective view of the apparatus 10, and FIGS. 2 through 7, respective face views of the apparatus 10, according to the preferred embodiment of the present invention, are disclosed. The apparatus 10 includes a backing plate 20 equipped with a pivoting lock bar 90, and a pair of chains 60, and 80 interconnected with a compression spring 70. The backing plate 20 is a "V"-shaped aluminum casting having a planar first wing 22 attached to a planar second wing 26 by means of a formed intermediate bend 24. The intermediate bend 24 places the second wing 26 at an angle of between ninety degrees (90°) and one hundred seventy-nine degrees (179°) relative to the first wing 22. This configuration permits the wood piece 200 to be cradled along a second face 32 of the backing plate 20. The backing plate 20 is provided with at least two (2) reinforcement flanges 34 along a first face 28 to augment the structural rigidity thereof. A reinforcement flange 34 is preferably located along each longitudinal edge of the backing plate 20. However, additional reinforcement flanges 34 may be cast along any portion of the backing plate 20 as may be necessary to provide an adequate structural integrity without limiting the scope of the apparatus 10.

An anchor plate 36 is disposed along a first face 28 of the first wing 22 at a distal edge opposite from the intermediate bend 24. The anchor plate 36 provides an attachment point for the first chain 60. The anchor plate 36 may have any appropriate configuration to provide the adequate connection of the first chain 60 to the backing plate 20. An anchor shackle 50, configured to be a commercially available fastening component, is threaded through a chain link 64 at a first chain first end 62 and secured into an aperture (not specifically shown) in the anchor plate 36 by means of an anchor pin 52. The cylindrical, headed anchor pin 52 is inserted into the aligned apertures (not shown) of the anchor shackle 50 and the anchor plate 36 in a typical fashion. The anchor pin 52 is retained in the anchor shackle 50 by means of a threaded anchor pin fastener 54, which is positively secured by an anchor pin retainer 56, such as a cotter pin, or the like. The use of both an anchor pin fastener 54 and an anchor pin retainer 56 provides a redundancy to the securement of the anchor pin 52 to obviate a failure thereof due to the impact forces exerted upon the apparatus 10 during use.

A spring first end 72 is connected to a first chain second end 66 by a standard means of the engagement of a spring eye 72 into a chain link 64. The spring eye 74 may be partially, or completely, wound around the chain link 64 to secure the connection without limiting the scope of the apparatus 10. A spring second end 78 is connected to a second chain first end 82 of a second chain 80 by a similar means. The spring 70 is a commercially available component having a plurality of spring coils 76 and a sufficient spring rate to adequately retain the wood piece 200, both before and after splitting. The first chain 60 and the second chain 80 are configured to be a plurality of chain links 64 of any of a variety of commercially available chains having a size suitable for the intended purpose.

A matched pair of lock bar pivot plates 42 is disposed along a distal edge of the first face 28 of the second wing 26. The lock bar pivot plates 42, preferably cast into the backing plate 20, provide an attachment point for the lock bar 90. The lock bar 90 provides a conditional attachment point for the second chain 80 and a means to functionally attach the apparatus 10 to a wood piece 200 either as a single unit, or as a collection of smaller split wood pieces 200. The lock bar 90 consists of an arcuate, cylindrical lock bar shaft 92, a lock bar pivot 98, and a binder hook 94. The lock bar shaft 92 is configured to have a plurality of defining bends which result in a divergence from the first face 22 of the backing plate 20 and then a corresponding convergence therewith to achieve a gap between the lock bar 90 and the backing plate 20 for the insertion of a user's hand, or hands, as a grasping position to facilitate the handling and maneuvering of the apparatus 20 and the retained wood piece(s) 200. The lock bar pivot 98 is an annular ring attached to, or formed with, the lock bar shaft 92. The lock bar pivot 98 serves as an attachment point for the lock bar 90 to the lock bar pivot plates 42, as well as an over-center pivot to gather the first chain 60, the spring 70, and the second chain 80 around the wood piece 200. As stated, the lock bar 90 is attached through the lock bar pivot 98 to the lock bar pivot plates 42 by means of a lock bar pivot pin 100. The cylindrical, headed lock bar pivot pin 100 is similar in construction to the previously disclosed anchor pin 52. The lock bar pivot pin 100 is provided with a threaded pivot pin fastener 102, which is further secured by a pivot pin retainer 104, such as a cotter pin, or the like. The binder hook 94 is an arcuate attachment of the lock bar 90 intended to be engaged into a convenient chain link 64 of the second chain 80 to complete the attachment of the backing plate 20 to the wood piece 200.

A pair of latch plates 46 is disposed along a first face 28 of the first wing 22 of the backing plate 20 in proximity to the anchor plate 36. Each latch plate 46 is provided with a latch plate aperture 48 as illustrated in FIG. 1. The latch plate apertures 48 are aligned for the insertion of a latch pin 110. The distance between the latch plates 46 is to accommodate the insertion of the distal end of the lock bar 90. The lock bar 90 is intended to be retained between the latch plates 46 by the latch pin 110. The latch pin 90 is composed of a cylindrical latch pin shaft 112 to which a preferably circular latch pin limit plate 116 is attached. A torus shaped latch pin eye 114 is attached to the latch pin limit plate 116 opposite from the latch pin shaft 112. The latch pin eye 114 provides a grasping surface to aid in the insertion of the latch pin 110 into the latch plate apertures 48 and the removal therefrom. It is preferred that a tether 111 attaches the latch pin 110 to one (1) of the latch plates 46, in order to ensure that the latch pin 110 does not get lost. It is appreciated that the latch pin 110 is of a length that ensures that it will be retained within the pair of latch plates 46 when installed through the apertures 48. If required, a latch pin retainer 118, configured to be a commercially available quick pin, or the like, can be inserted into a latch pin aperture 117 in a distal end of the latch pin shaft 112 to retain the latch pin 110.

Figure 8:
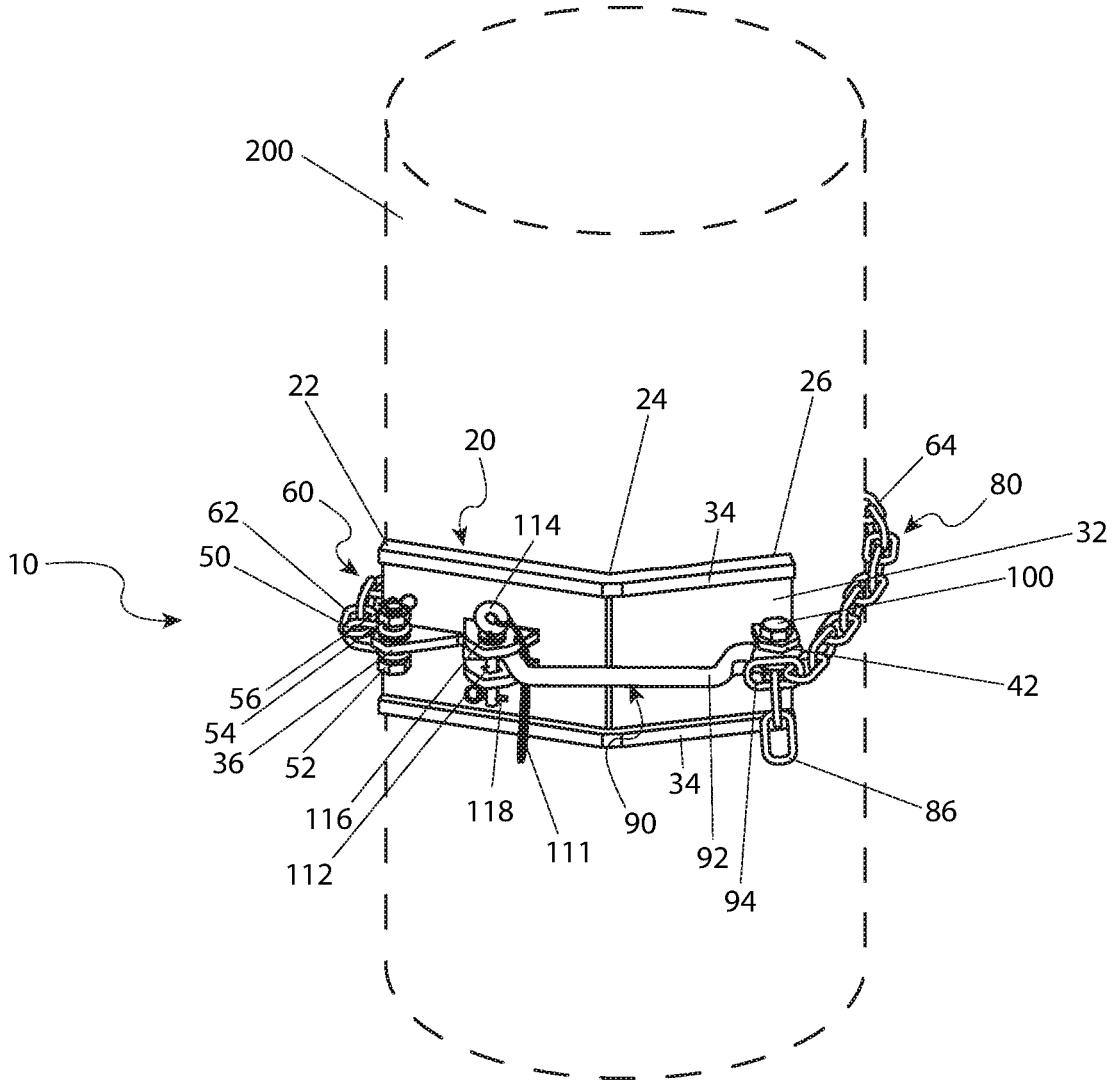

Referring now to FIG. 8, a perspective view of the apparatus 10, encircling a wood piece 200, according to the preferred embodiment of the present invention, is disclosed. In use, the second face 32 of the backing plate 20 is placed into contact with a single wood piece 200, not having been split, approximately at the longitudinal center thereof. The lock bar 90 is pivoted about the lock bar pivot pin 100 to orient the binder hook 94 in proximity to the wood piece 200. The first chain 60, the spring 70, and the second chain 80 are wrapped around an opposite side of the wood piece 200 so as to encircle the wood piece 200. Any chain link 64 of the taut second chain 80 falling in proximity to the binder hook 94 is engaged therewith and the lock bar 90 is pivoted about the lock bar pivot pin 100 to engage the distal end of the lock bar shaft 92 into the latch plates 46. This maneuver tightens the chains 60, 80 around the wood piece 200 thereby extending the spring 70 to compensate for the over-center location of the binder hook 94. The latch pin 110 then inserted into the latch plate apertures 48 and secured through the latch pin aperture 117 with the latch pin retainer 118. The wood piece 200 can subsequently split into smaller wood pieces 200 in a typical manner with an axe, or a wedge. After having split the wood piece 200 into appropriate sizes, the wood pieces 200, still bound by the apparatus 10, can be transferred to a stacked woodpile, or other desired location, by utilizing the lock bar shaft 92 as a handle. When the wood pieces 200 have been transfer to the desired location, the apparatus 10 can be removed therefrom by removing the latch pin retainer 118 from the latch pin aperture 117 freeing the latch pin 110; pivoting the lock bar 90 away from the backing plate 20 to reduce the tension in the spring 70; and disengaging the chain link 64 from the binder hook 94.

Figure 2:
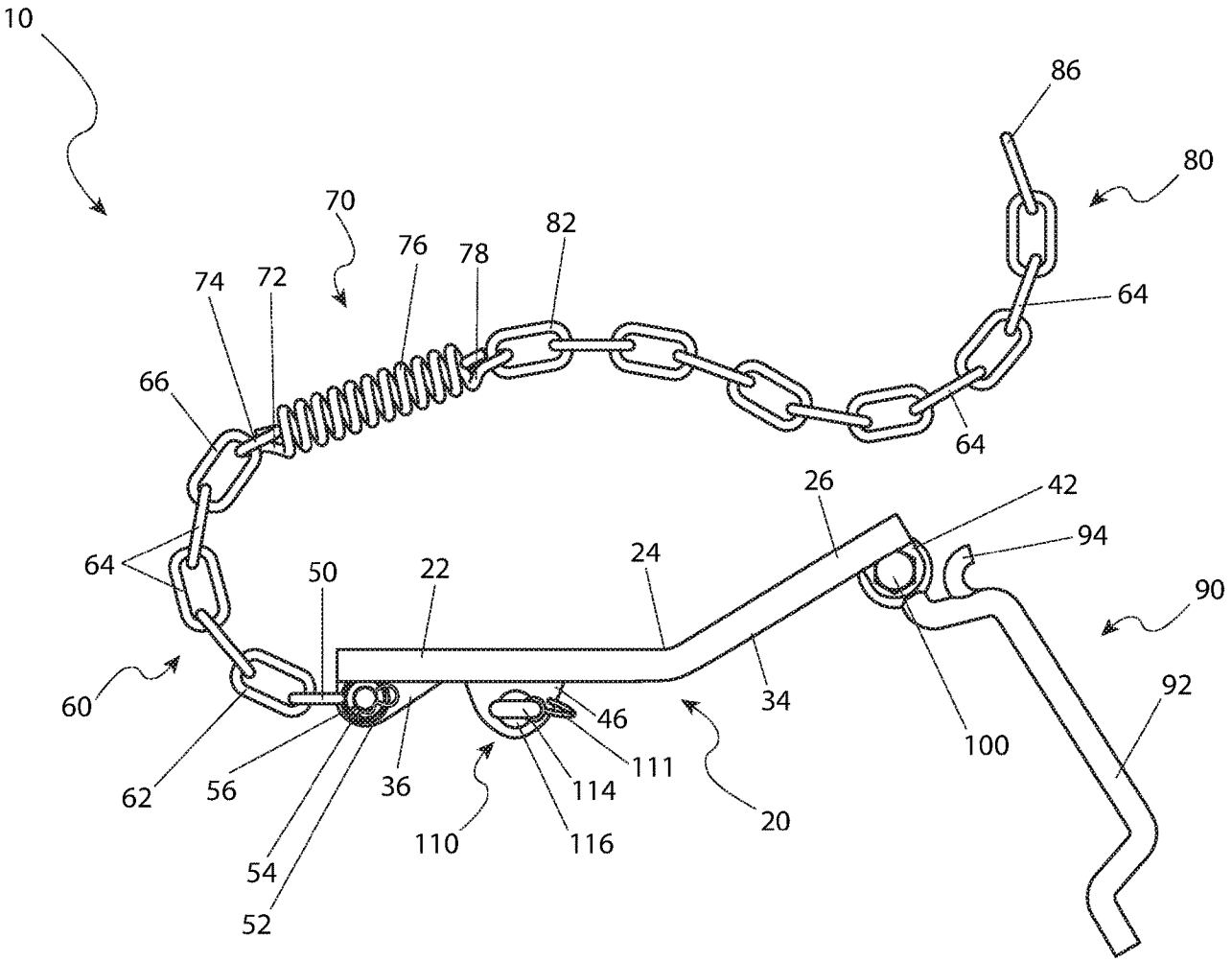
FIG. 2 is a top view of the wood retention device 10 in accordance with the preferred embodiment of the present invention.
Figure 3:
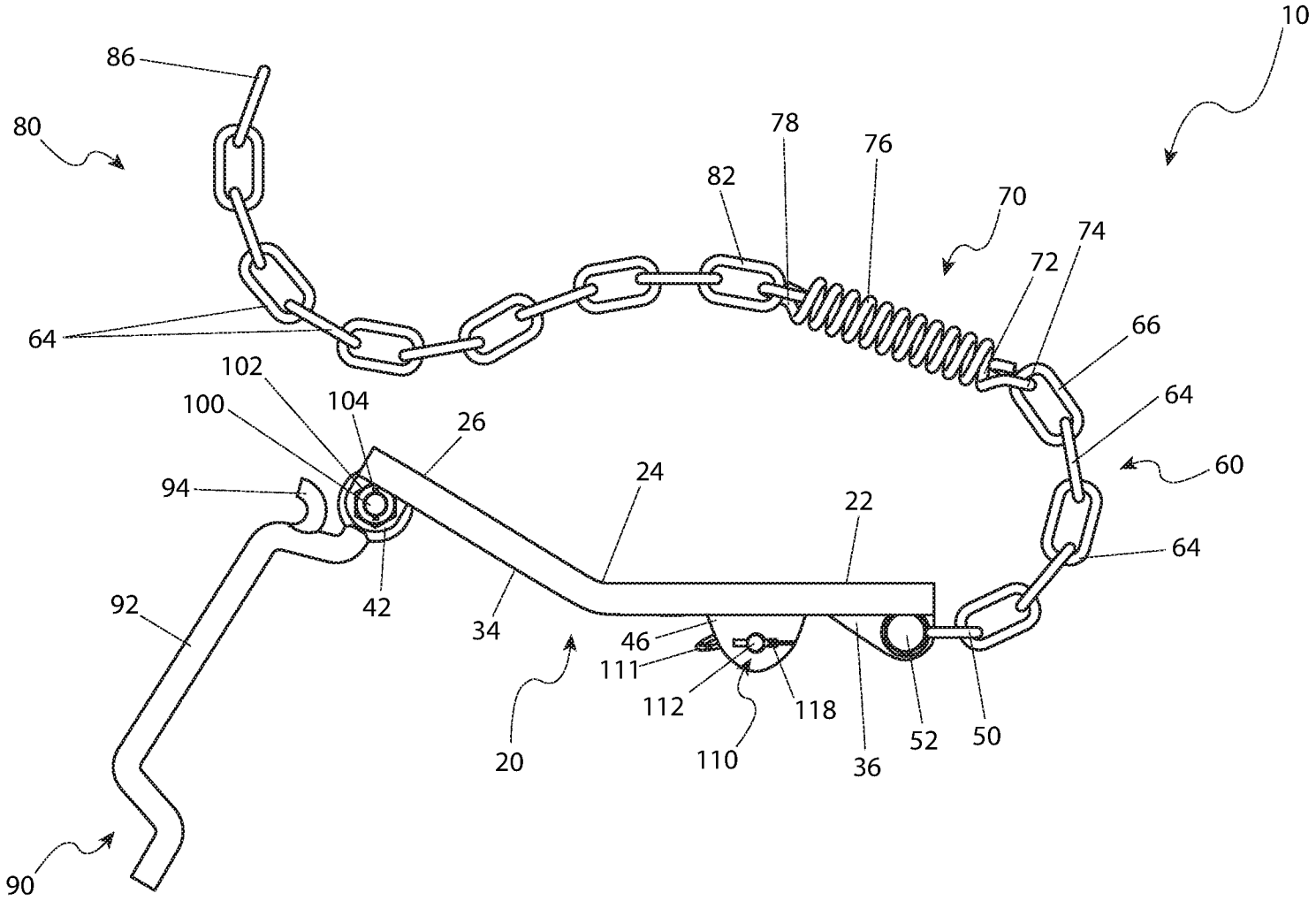
FIG. 3 is a bottom view of the wood retention device 10 in accordance with the preferred embodiment of the present invention.
Figure 4:
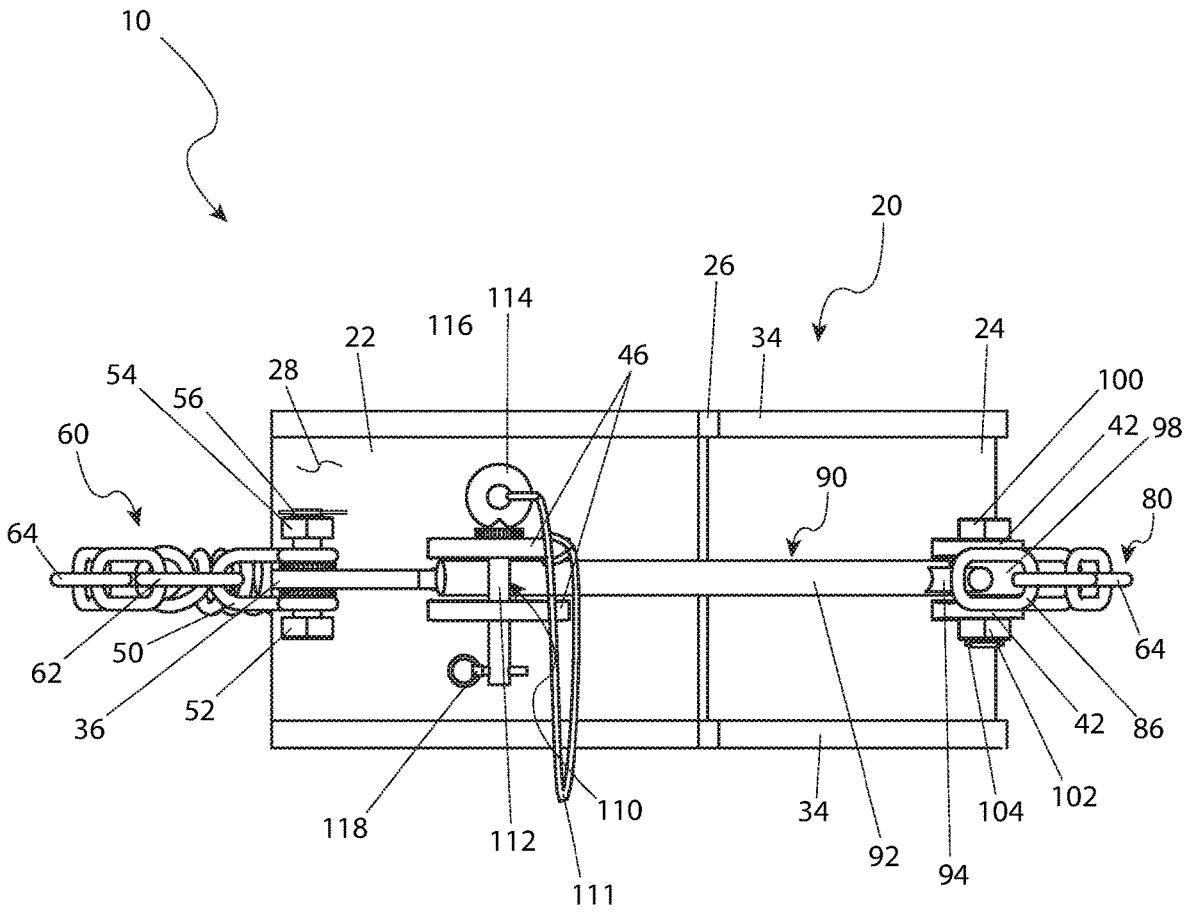
FIG. 4 is a front view of the wood retention device 10 in accordance with the preferred embodiment of the present invention.
Figure 5:
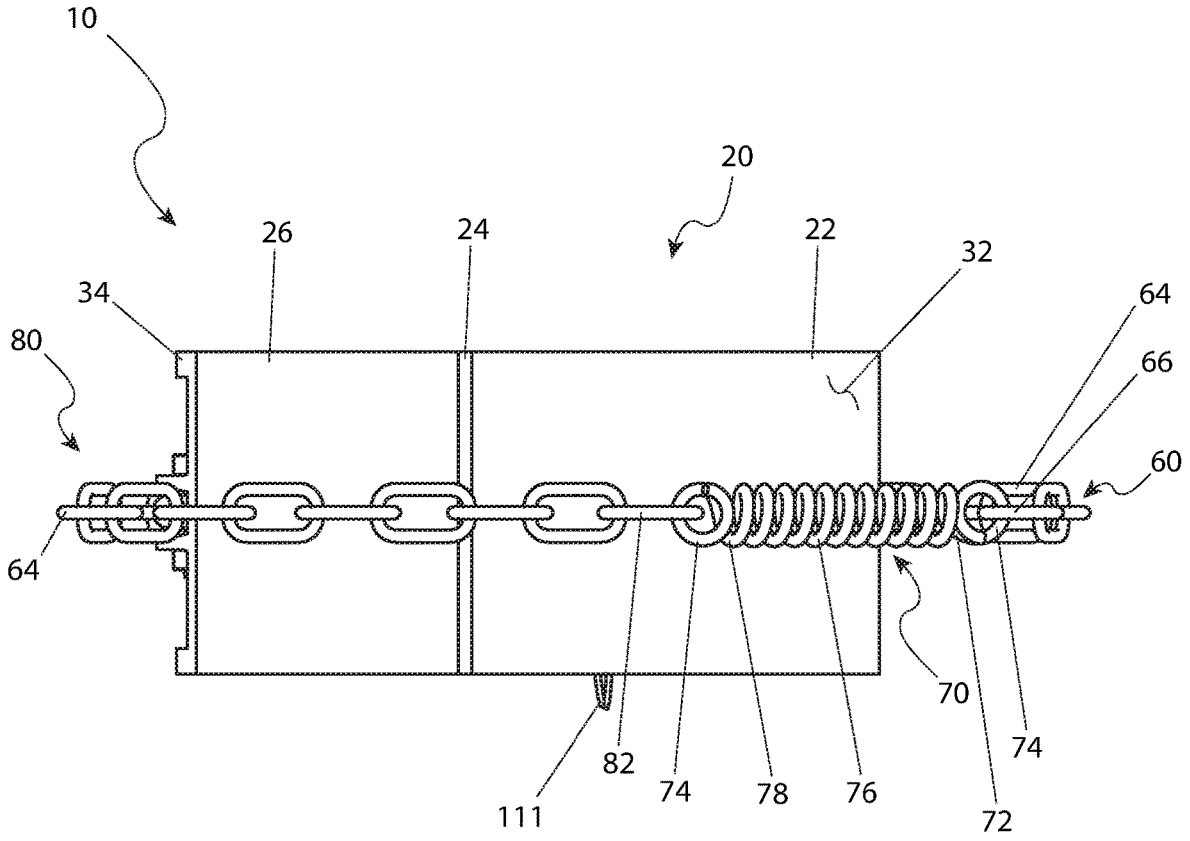
FIG. 5 is a rear view of the wood retention device 10 in accordance with the preferred embodiment of the present invention.
Figure 6:
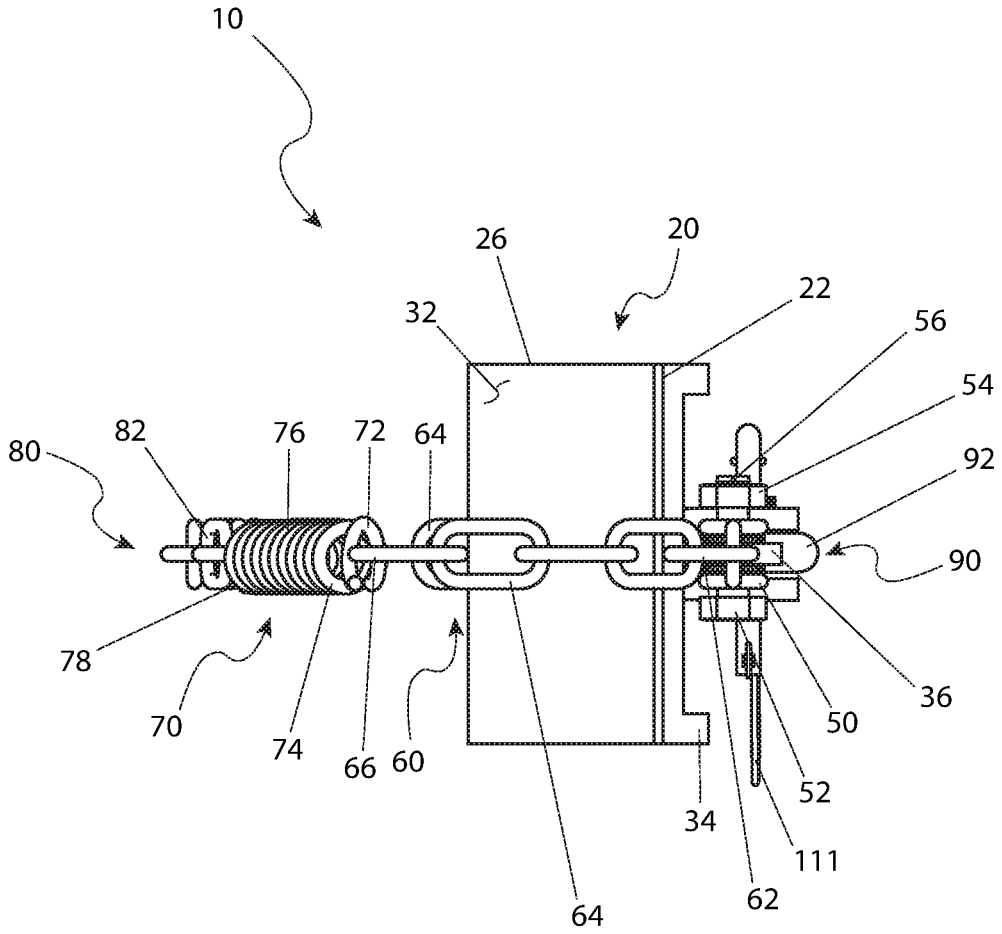
FIG. 6 is a first side view of the wood retention device 10 in accordance with the preferred embodiment of the present invention.
Figure 7:
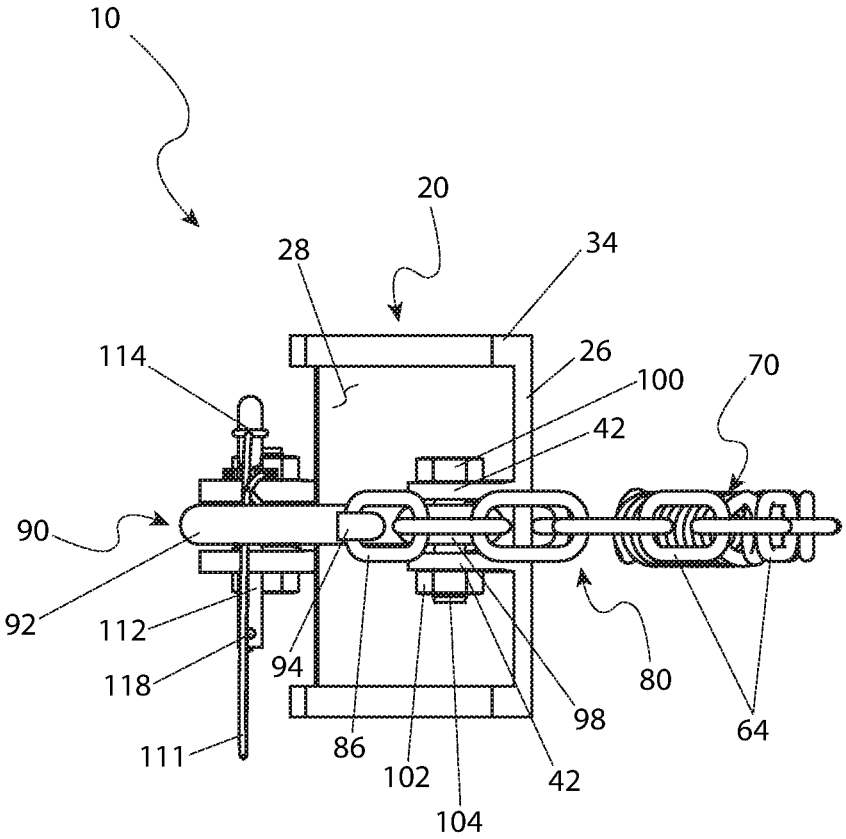
FIG. 7 is an opposite side view of the wood retention device 10 in accordance with the preferred embodiment of the present invention; and, FIG. 8 is a perspective view of the wood retention device 10 encircling a wood piece 200 in accordance with the preferred embodiment of the present invention.

The preferred embodiment of the present invention can be utilized by an enabled individual in a simple and straightforward manner with little or no training After initial purchase or acquisition of the apparatus 10, it would be installed as indicated in FIG. 2. The method of installing and utilizing the apparatus 10 may be achieved by performing the steps listed in the previous discussion.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A split wood retention device, comprising:

a backing plate, comprising:

a first wing, comprising:

a first wing first face;

a first wing second face;

a first wing first end;

a first wing second end;

a first wing top edge;

a first wing bottom edge;

an anchor plate having an anchor plate aperture disposed therein secured to said first wing first face adjacent said first wing first end and between said first wing top edge and said first wing bottom edge;

a first latch plate having a first latch plate aperture disposed therein secured to said first wing first face adjacent an inside edge of said anchor plate and between said first wing top edge and said first wing bottom edge;

a second latch plate having a second latch plate aperture disposed therein secured to said first wing first face adjacent said inside edge of said anchor plate and between said first wing top edge and said first wing bottom edge and subjacent said first latch plate with said first latch plate aperture aligned with said second latch plate aperture;

a second wing, comprising:

a second wing second face;

a second wing first end;

a second wing second end;

a second wing top edge;

a second wing bottom edge;

a first lock bar plate having a first lock bar plate aperture disposed therein secured to said second wing first face adjacent said second wing second end and between said second wing top edge and said second wing bottom edge;

a second lock bar plate having a second lock bar plate aperture disposed therein secured to said second wing first face adjacent said second wind second end and between said second wing top edge and said second wing bottom edge and subjacent said first lock bar plate with said first lock bar plate aperture aligned with said second lock bar plate aperture;

a chain secured to said anchor plate;

a latch pin secured to said first latch plate;

a lock bar moveably secured between said first lock bar plate and said second lock bar plate;

wherein said backing plate is configured to cradle a portion of a piece of wood against said first wing second face and said second wing second face;

wherein said chain is configured to circumscribe a remainder of said piece of wood and removably secure to said lock bar; and, wherein when said chain is removably secured to said lock bar and when said lock bar is thereafter rotated between said first latch plate and said second latch plate and said first wing first face, said piece of wood is retained within said split wood device by said latch pin being placed within said first latch plate aperture and said second latch plate aperture;

wherein said chain comprises:

a first chain having a first chain first end and a first chain second end;

a second chain having a second chain first end and a second chain second end;

a spring having a spring first end connected to said first chain second end and a spring second end connected to said second chain first end;

wherein said spring is secured to said anchor plate with an anchor pin;

wherein said latch pin comprises:

a latch pin shaft having a latch pin first end and a latch pin second end;

a latch pin eye secured at said latch pin first end;

a latch pin aperture disposed adjacent said latch pin second end;

a latch pin limit plate subjacent said latch pin eye;

a latch pin retainer capable of being removably secured within said latch pin aperture;

a tether secured to said latch pin eye and said first latch plate adjacent said first latch plate aperture;

wherein said backing plate comprises aluminum;

wherein said first wing top edge and said first wing bottom edge comprise a first wing top edge flange and a first wing bottom edge flange; and wherein said first wing top edge flange and said first wing bottom edge flange further comprise a contiguous second wing top edge flange and a second wing bottom edge flange.

2. The split wood device of claim 1, wherein said backing plate comprises a bend between said first wing and said second wing.

3. The split wood device of claim 1, wherein said lock bar comprises:

a lock bar shaft having a lock bar shaft first end and a lock bar shaft second end;

a lock bar pivot secured at said lock bar shaft first end;

a lock bar pivot aperture; and a binder hook secured adjacent an interior side of said lock bar pivot.

4. The split wood device of claim 3, wherein said lock bar is removably secured between said first lock bar plate and said second lock bar plate by a lock bar pivot pin removably secured within said first lock bar plate aperture, said lock bar pivot aperture and said second lock bar plate aperture;

wherein said chain is removably securable to said binder hook.

5. A split wood retention device, comprising:

a backing plate having a bend, comprising:

a first wing, comprising:

a first wing first face;

a first wing second face;

a first wing first end;

a first wing second end;

a first wing top edge;

a first wing bottom edge;

an anchor plate having an anchor plate aperture disposed therein secured to said first wing first face adjacent said first wing first end and between said first wing top edge and said first wing bottom edge;

a first latch plate having a first latch plate aperture disposed therein secured to said first wing first face adjacent an inside edge of said anchor plate and between said first wing top edge and said first wing bottom edge;

a second latch plate having a second latch plate aperture disposed therein secured to said first wing first face adjacent said inside edge of said anchor plate and between said first wing top edge and said first wing bottom edge and subjacent said first latch plate with said first latch plate aperture aligned with said second latch plate aperture;

a second wing, comprising:

a second wing second face;

a second wing first end;

a second wing second end;

a second wing top edge;

a second wing bottom edge;

a first lock bar plate having a first lock bar plate aperture disposed therein secured to said second wing first face adjacent said second wing second end and between said second wing top edge and said second wing bottom edge;

a second lock bar plate having a second lock bar plate aperture disposed therein secured to said second wing first face adjacent said second wind second end and between said second wing top edge and said second wing bottom edge and subjacent said first lock bar plate with said first lock bar plate aperture aligned with said second lock bar plate aperture;

a chain secured to said anchor plate;

a latch pin secured to said first latch plate; and a lock bar moveably secured between said first lock bar plate and said second lock bar plate;

wherein said backing plate is configured to cradle a portion of a piece of wood against said first wing second face and said second wing second face;

wherein said chain is configured to circumscribe a remainder of said piece of wood and removably secure to said lock bar;

wherein when said chain is removably secured to said lock bar and when said lock bar is thereafter rotated between said first latch plate and said second latch plate and said first wing first face, said piece of wood is retained within said split wood device by said latch pin being placed within said first latch plate aperture and said second latch plate aperture;

wherein said bend comprises an angle defined between said first wing and said second wing between ninety degrees and one hundred seventy-nine degrees;

wherein said chain comprises:

a first chain having a first chain first end and a first chain second end;

a second chain having a second chain first end and a second chain second end; and, a spring having a spring first end connected to said first chain second end and a spring second end connected to said second chain first end;

wherein said spring is secured to said anchor plate with an anchor pin;

wherein said latch pin comprises:

a latch pin shaft having a latch pin first end and a latch pin second end;

a latch pin eye secured at said latch pin first end;

a latch pin aperture disposed adjacent said latch pin second end;

a latch pin limit plate subjacent said latch pin eye;

a latch pin retainer capable of being removably secured within said latch pin aperture; and a tether secured to said latch pin eye and said first latch plate adjacent said first latch plate aperture;

wherein said backing plate comprises aluminum;

wherein said first wing top edge and said first wing bottom edge comprise a first wing top edge flange and a first wing bottom edge flange; and wherein said first wing top edge flange and said first wing bottom edge flange further comprise a contiguous second wing top edge flange and a second wing bottom edge flange.

6. The split wood device of claim 5, wherein said lock bar comprises:

a lock bar shaft having a lock bar shaft first end and a lock bar shaft second end;

a lock bar pivot secured at said lock bar shaft first end;

a lock bar pivot aperture; and a binder hook secured adjacent an interior side of said lock bar pivot.

7. The split wood device of claim 6, wherein said lock bar is removably secured between said first lock bar plate and said second lock bar plate by a lock bar pivot pin removably secured within said first lock bar plate aperture, said lock bar pivot aperture and said second lock bar plate aperture, wherein said chain is removably securable to said binder hook.

* * * * *